US010041654B1

(12) United States Patent
Ernst et al.

(10) Patent No.: US 10,041,654 B1
(45) Date of Patent: Aug. 7, 2018

(54) ADJUSTABLE LIGHTING FINISHING STRUCTURE

(71) Applicants: Oliver Ernst, Peachtree City, GA (US); Grzegorz Wronski, Peachtree City, GA (US)

(72) Inventors: Oliver Ernst, Peachtree City, GA (US); Grzegorz Wronski, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 117 days.

(21) Appl. No.: 14/942,368

(22) Filed: Nov. 16, 2015

(51) Int. Cl.

| | |
|---|---|
| ***F21V 7/00*** | (2006.01) |
| ***F21V 17/02*** | (2006.01) |
| ***F21S 8/02*** | (2006.01) |
| ***F21V 21/04*** | (2006.01) |
| ***F21V 17/06*** | (2006.01) |

(52) U.S. Cl.
CPC ..... *F21V 17/02* (2013.01); *F21S 8/026* (2013.01); *F21V 17/06* (2013.01); *F21V 21/04* (2013.01)

(58) Field of Classification Search
CPC ..... F21V 17/02; F21V 17/06; F21V 17/00; F21V 21/04; F21V 19/00; F21V 19/0005; F21V 19/001; F21V 19/002; F21V 19/0015; F21V 19/0025; F21V 19/003; F21V 19/0035; F21V 19/0045; F21V 19/005; F21V 19/0055; F21S 8/026
USPC ..... 362/257
See application file for complete search history.

(56) References Cited

U.S. PATENT DOCUMENTS

| | | | | |
|---|---|---|---|---|
| 8,408,758 | B2 * | 4/2013 | Patti | F21S 8/02 362/287 |
| 9,239,153 | B2 * | 1/2016 | Goodman | F21V 21/00 |
| 2005/0168986 | A1 * | 8/2005 | Wegner | F21S 8/026 362/241 |
| 2011/0141741 | A1 * | 6/2011 | Engstrom | F21V 21/03 362/257 |
| 2013/0051012 | A1 * | 2/2013 | Oehle | F21S 8/026 362/235 |
| 2014/0029252 | A1 * | 1/2014 | Kato | F21V 23/002 362/235 |
| 2017/0059102 | A1 * | 3/2017 | Grant | F21S 8/026 |

* cited by examiner

*Primary Examiner* — Elmito Breval
*Assistant Examiner* — Omar Rojas Cadima
(74) *Attorney, Agent, or Firm* — King & Spalding LLP

(57) ABSTRACT

A finishing section for a recessed lighting fixture includes a trim structure that includes a shielding reflector and a trim ring. The shielding reflector is attached to the trim ring. The finishing section further includes a ring structure attached to the shielding reflector distal from the trim ring. The trim structure and the ring structure are rotatable relative to each other.

20 Claims, 10 Drawing Sheets

ADJUSTABLE LIGHTING FINISHING STRUCTURE

TECHNICAL FIELD

The present disclosure relates generally to light fixtures, and in particular to adjustment of a finishing section of a light fixture.

BACKGROUND

When a non-circular finishing section is installed into a recessed light fixture housing, the orientation of the finishing section (e.g., a trim of the light fixture) is defined by the position of the installed housing. To illustrate, attachment of the finishing section to the housing may be performed using attachment structures of the housing. For example, the housing may include torsion spring receivers as its attachment structures to receive torsion springs that are coupled to the finishing section or to another structure that is attached to the finishing section. Thus, orientation of the finishing section may be dependent on the position of the attachment structures of the housing, which is determined by the position of the recessed housing.

To illustrate, if a recessed housing of a first light fixture is misaligned relative to, for example, a recessed housing of a second light fixture, the finishing section of the first housing fixture may be misaligned relative to the finishing section of the second light fixture. Remedying such misalignment may require re-installation of a light fixture, which may be time consuming and costly. Further, the effort to accurately align multiple recessed housings with each other and/or with another reference may be time consuming. Thus, an adjustable finishing structure that is adjustable to remedy misalignment after installation may be desirable.

SUMMARY

In general, the present disclosure relates generally to light fixtures, and in particular to post-installation adjustment of a finishing section of a light fixture. In an example embodiment, a finishing section for a recessed lighting fixture includes a trim structure that includes a shielding reflector and a trim ring. The shielding reflector is attached to the trim ring. The finishing section further includes a ring structure attached to the shielding reflector distal from the trim ring, wherein the trim structure and the ring structure are rotatable relative to each other.

In another example embodiment, a lighting structure for a recessed lighting fixture includes a trim structure that includes a shielding reflector and a trim ring. The shielding reflector is attached to the trim ring. The lighting structure further includes a ring structure attached to the shielding reflector distal from the trim ring. The ring structure includes a first bracket attachment tab and a second bracket attachment tab. The lighting structure also includes a bracket attached to the ring structure. The bracket includes a first leg and a second leg. An end portion of the first leg extends through a first slot between the first bracket attachment tab and the ring structure, and an end portion of the second leg extends through a second slot between the second bracket attachment tab and the ring structure.

In another example embodiment, a lighting structure for a recessed lighting fixture includes a trim structure comprising a shielding reflector and a trim ring. The shielding reflector is attached to the trim ring. The lighting structure further includes a ring structure attached to the shielding reflector distal from the trim ring. The trim structure and the ring structure are rotatable relative to each other. The lighting structure further includes a reflector attached to the ring structure. The reflector has an opening distal from the ring structure to receive a lamp socket.

These and other aspects, objects, features, and embodiments will be apparent from the following description and the claims.

BRIEF DESCRIPTION OF THE DRAWINGS

Reference will now be made to the accompanying figures, which are not necessarily to scale, and wherein.

Figure 1A:
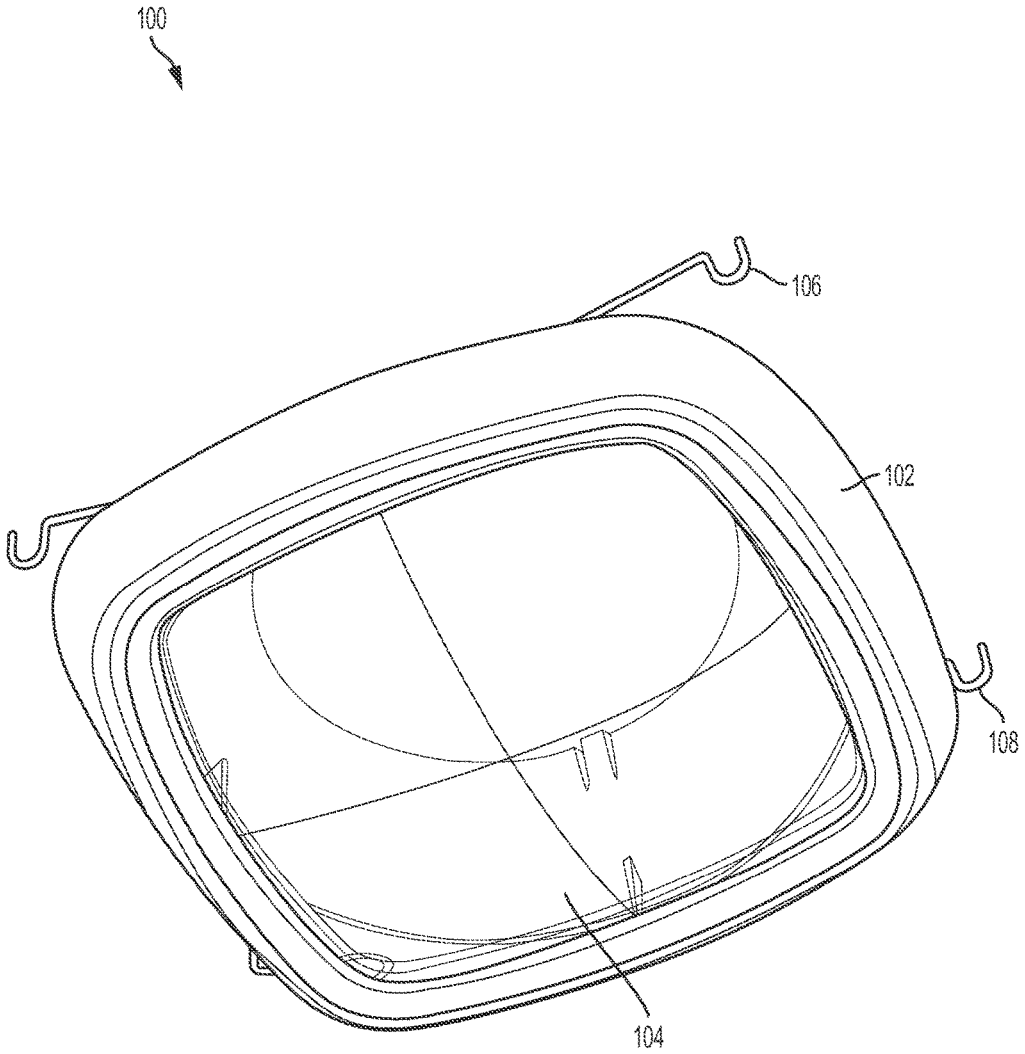
FIG. 1A illustrates a bottom isometric view of a finishing section according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the figures, reference numerals designate like or corresponding, but not necessarily identical, elements.

DETAILED DESCRIPTION OF THE EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Figure 1B:
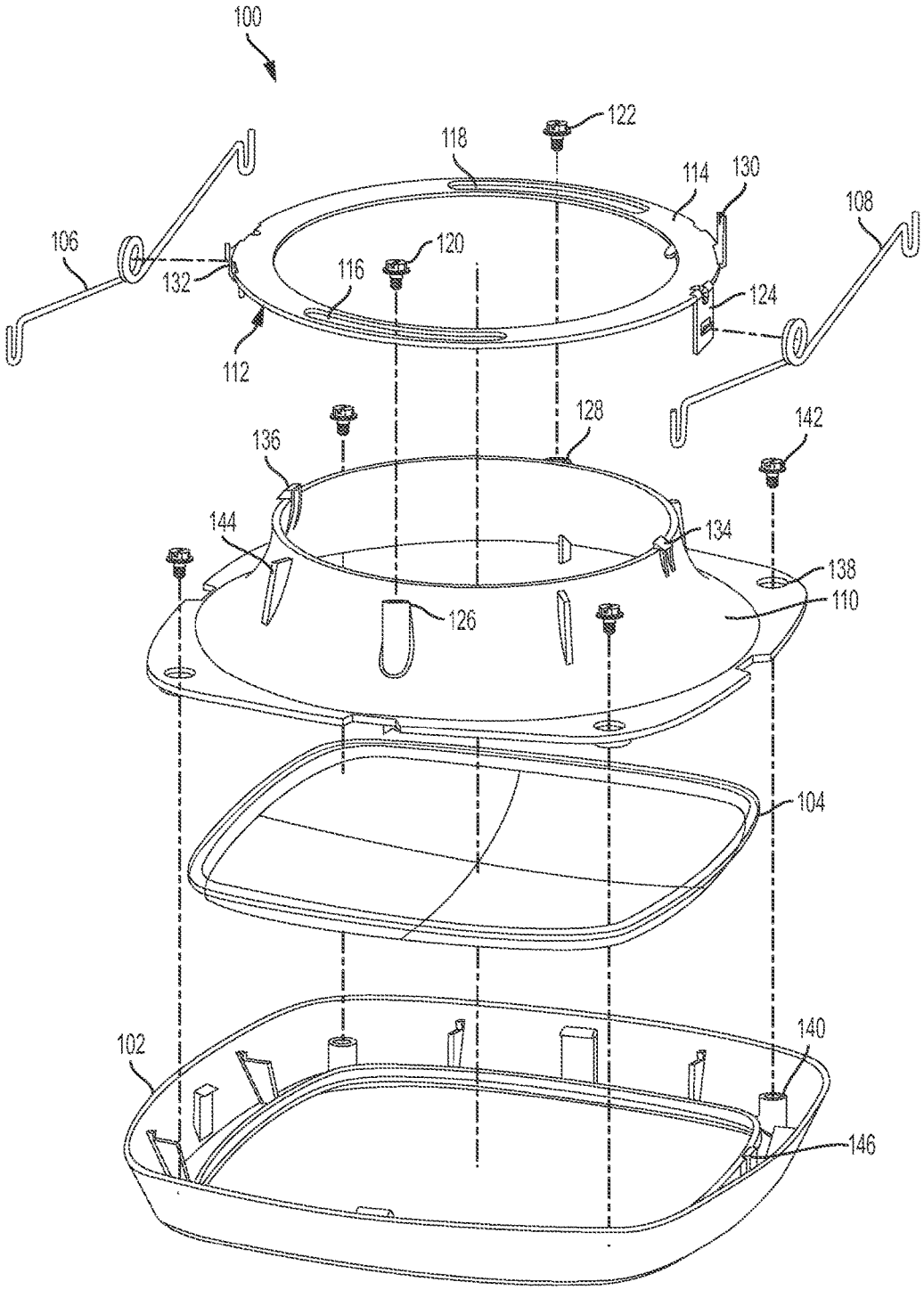
FIG. 1B illustrates an exploded view of the finishing section of FIG. 1A according to an example embodiment.

Turning now to the drawings, example embodiments are described. FIG. 1A illustrates a bottom isometric view of a finishing section 100 according to an example embodiment. FIG. 1B illustrates an exploded view of the finishing section 100 of FIG. 1A according to an example embodiment. Referring to FIGS. 1A and 1B, the finishing section 100 includes a trim ring 102, a lens 104, and torsion springs 106, 108 for attaching the finishing section 100 to a housing of a light fixture, such as a recessed light fixture.

In some example embodiments, the finishing section 100 includes a shielding reflector 110 and a ring structure 112. The lens 104 is positioned between the trim ring 102 and the shielding reflector 110 and may rest on the trim ring 102. The ring structure 112 includes a plate 114, where arcuate slots 116, 118 are formed therethrough. For example, each of the arcuate slots may form an arc of approximately 45 degrees. A fastener (e.g., a screw) 120 may extend through the arcuate slot 116 for attachment to the shielding reflector 110. For example, the shielding reflector 110 may include an attachment boss 126 for receiving the fastener 120. A fastener (e.g., a screw) 122 may extend through the arcuate slot 118 for attachment to the shielding reflector 110. For example, the shielding reflector 110 may include an attachment boss 128 for receiving the fastener 122. In some example embodiments, the head of each fastener 120, 122 may remain on a side of the plate 114 facing away from the trim ring 102 to retain the ring structure 112 attached to the shielding reflector 110.

In some example embodiments, the ring structure 112 includes a torsion spring tab 124 and another corresponding tab that extend down from the plate 114 and that are used for attachment of the torsion springs 106, 108 to the ring structure 112. To illustrate, the torsion spring 108 may be attached to the tab 124 and the torsion spring 106 may be attached to the other tab for attaching the ring structure 112 to a housing. In some example embodiments, the tab 124 and the other tab may extend in a different direction than shown in FIG. 1B without departing from the scope of this disclosure.

In some example embodiments, the ring structure 112 includes bracket attachment tabs 130, 132. The tabs 130, 132 may be used for attachment of a bracket (shown in FIG. 3) to the ring structure 112 as described below. In some alternative embodiments, the tabs 130, 132 may be omitted. For example, the tabs 132, 130 may be omitted when the finishing section 100 is used without the bracket shown in FIG. 3.

In some example embodiments, the shielding reflector 110 may include hooks 134, 136 that are used to retain the ring structure 112 attached to the ring structure 112. The hooks 134, 136 may be positioned radially opposite to each other as shown in FIG. 1B. The hooks 134 may prevent or reduce bending of the ring structure 112 that may otherwise result from the weight of the trim ring 102, the lens 104, and the shielding reflector 110 and/or an upward force resulting from the attachment of the torsion springs 106, 108 to a housing. For example, each of the hooks 134 may be positioned approximately half way between the attachment bosses 126, 128 such that each of the hooks 134 is approximately halfway between the fasteners 120, 122 when the ring structure 112 is attached to the shielding reflector 110.

In some example embodiments, the shielding reflector 110 includes attachment holes 138 that are each aligned with a respective one of the attachment bosses 140 formed in the trim ring 102. For example, each one of the attachment holes 138 may be at a respective corner of the shielding reflector 110. Screws 142 may be used to attach the trim ring 102 and the shielding reflector 110 together. To illustrate, each screw 142 may extend through a respective one of the attachment holes 138 into a respective one of the bosses 140 to attach the trim ring 102 and the shielding reflector 110 together. Alternatively or in addition, other means such as hooks 146 may be used to attach the trim ring 102 and the shielding reflector 110 together.

In some example embodiments, the trim ring 102 may be made from plastic by a method such as molding or may also be made from a die cast material. The shielding reflector 110 may be made from plastic by methods such as molding. The ring structure 112 may be made from steel (e.g., galvanized steel) or another suitable material as may be contemplated by those of ordinary skill in the art with the benefit of this disclosure. For example, the ring structure 112 may be made using methods such as stamping. The lens 104 may be made from a suitable material such as acrylic.

When the ring structure 112 is attached to the shielding reflector 100, the shielding reflector 110 and the ring structure 112 may be rotated with respect to each other limited by the arc size of the arcuate slots 116, 118. Because the trim ring 102 is rotationally fixed with respect to the shielding reflector 110, the trim ring 102 rotates along with the shielding reflector 110 and relative to the ring structure 112. In some example embodiments, the shielding reflector 110 may include one or more ribs 144 that are used to prevent rotation of the trim ring 102 and the shielding reflector 110 relative to the ring structure 112.

In some example embodiments, the finishing section 100 may include a single trim structure that includes the trim ring 102 and the reflecting shield 110. To illustrate, the trim structure may include the trim ring 102 and the reflecting shield 110 that formed together integrally as a single structure or that are formed as separate structures and attached to each other as described above. Although the trim ring 102 is shown as having a generally rectangular shape, in some alternative embodiments, the trim ring 102 may have other shapes. For example, the trim ring 102 may have a non-circular shape such as a triangle. The shielding reflector 110 may also have shapes other than shown in FIG. 1B without departing from the scope of this disclosure. The lens 104 may also have shapes other than in FIG. 1B. Further, the ring structure 112 may have non-circular inner and outer perimeters without departing from the scope of this disclosure. In some alternative embodiments, the finishing section 100 may include attachment structures other than torsion springs 106, 108 for attachment of the finishing section 100 to a housing. Further, in some alternative embodiments, the torsion spring tab 124 may be omitted, and the torsion spring 106, 108 or other attachment structures may be attached to the ring structure 112 by other means without departing from the scope of this disclosure.

Figure 2A:
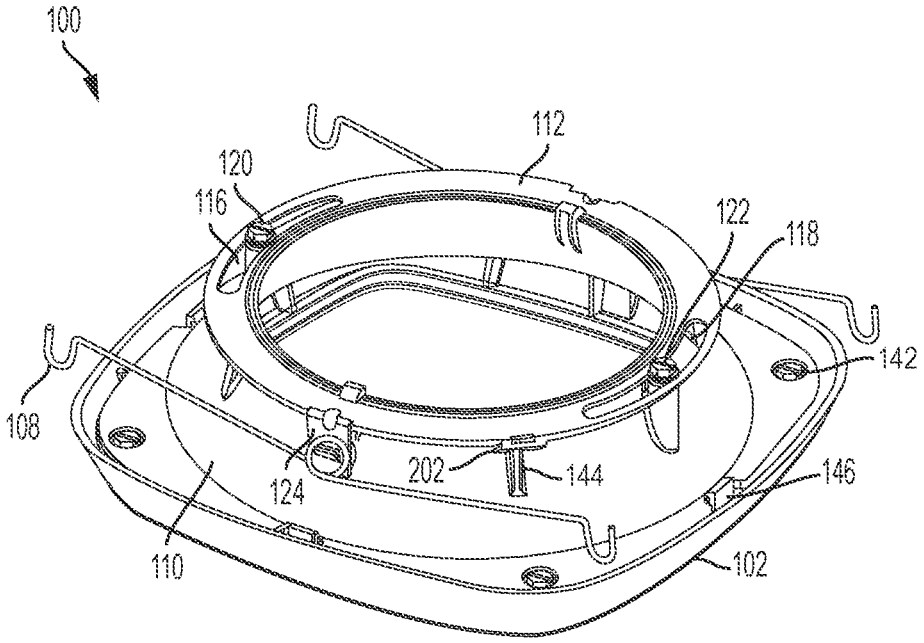
FIG. 2A-2C illustrate a top isometric view of the finishing section of FIG. 1A according to an example embodiment.
Figure 2B:
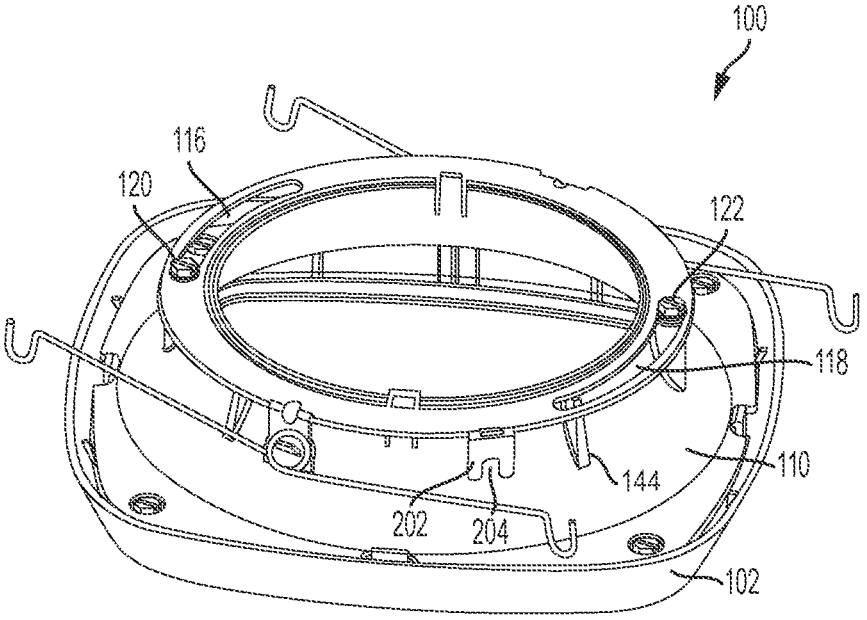
Figure 2C:
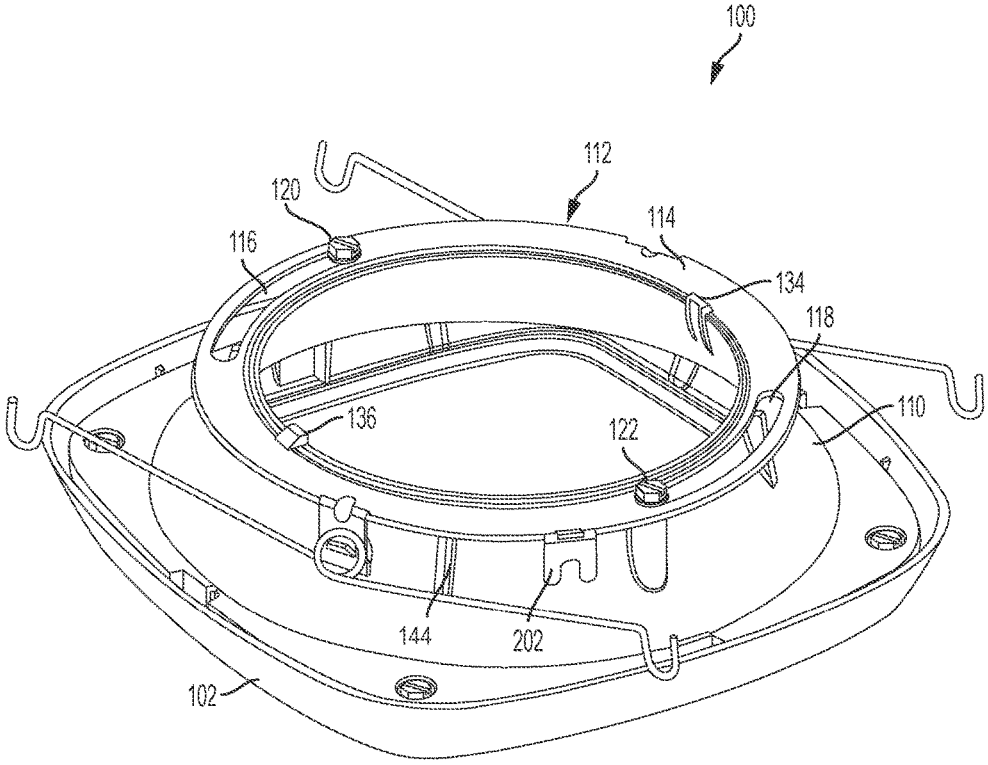

FIG. 2A-2C illustrate top isometric views of the finishing section 100 of FIG. 1A according to an example embodiment. As shown in FIGS. 2A-2C, the ring structure 112 is attached to the shielding reflector 110, and the shielding reflector 110 is attached to the trim ring 102. The fastener 120 extends through the arcuate slot 116 to attach to the shielding reflector 110, and the fastener 122 extends through the arcuate slot 118 to attach to the shielding reflector 110 across from the fastener 120. The fasteners 120, 122 extend through the respective arcuate slot 116, 118 such that the ring structure 112 can rotate. To illustrate, the ring structure 112 may be below the heads of the fasteners 120, 122 may not be tightened so that the ring structure 112 is allowed to rotate.

The trim ring 102 and the shielding reflector 110 are attached to each other by the fasteners 142 and the hooks 146. The trim ring 102 and the shielding reflector 110 are attached to each other such that the trim ring 102 and the shielding reflector 110 rotate together relative to the ring structure 112. In some alternative embodiments, the fasteners 142 or the hooks 146 may be omitted. In yet some other alternative embodiments, the trim ring 102 and the shielding reflector 110 may be attached to each other by means other than shown in FIGS. 2A-2C without departing from the scope of this disclosure.

In some example embodiments, the torsion spring 108 is attached to the torsion spring tab 124, and the torsion spring 106 is attached to the other torsion spring tab across from the tab 124. The torsion springs 106, 108 are attached to the ring structure 112 such that the torsion springs 106, 108 rotate along with the ring structure 112 with respect to the trim ring 102 and the shielding reflector 110.

As shown in FIG. 2A, in some example embodiments, the fasteners 120, 122 may be centrally located in the respective arcuate slot 120, 122. To illustrate, the fastener 120 is centrally located in the arcuate slot 116, and the fastener 122 is centrally located in the arcuate slot 118. For example, the finishing section 100 may be shipped with the ring structure 112 positioned with respect to the fasteners 120, 122, and thus, with respect to the trim ring 102 and the shielding reflector 110 as shown in FIG. 2A.

In some example embodiments, the ring structure 112 may include a locking tab 202 that may be used to prevent/resist a change in the relative rotational positions of the trim ring 102 and the shielding reflector 110 with respect to the ring structure 112. To illustrate, the locking tab 202 may include a slot 204 (e.g., a U-shaped slot as more clearly shown in FIG. 2B). To prevent/resist a change in the relative rotational positions of the trim ring 102 and the shielding reflector 110 with respect to the ring structure 112, the slot 204 of the tab 202 may be positioned around the rib 144 as shown in FIG. 2A. For example, the locking tab 202 may be bendable such that the rib 144 is extends through the slot 204. In some alternative embodiments, two separate tabs may be used instead of the locking tab 202 to prevent rotational movement. Further, in some alternative embodiments, the locking tab 202, including the slot 204, may have a different shape than shown in FIGS. 2A-2C without departing from the scope of this disclosure. To rotate the trim ring 102 and the shielding reflector 110 relative to the ring structure 112, the locking tab 202 may be pulled/pushed out such that the rib 144 is no longer positioned in the slot 204.

To illustrate, in FIG. 2B, the ring structure 112 is rotationally in a different position with respect to the trim ring 102 and the shielding reflector 110 than shown in FIG. 2A. For example, in FIG. 2B, the fastener 120 is at an end of the arcuate slot 116, and the fastener 122 is at an end of the arcuate slot 118. The locking tab 202 has been moved outwardly to allow the rotational movement of the trim ring 102 and the shielding reflector 110 relative to the ring structure 112. Once the fasteners 120, 122 are at the ends of the arcuate slots 116, 118, further rotation of the trim ring 102 and the shielding reflector 110 in a clockwise direction is prevented.

In FIG. 2C, the ring structure 112 is rotationally in a different position with respect to the trim ring 102 and the shielding reflector 110 than shown in FIGS. 2A and 2B. In FIG. 2C, compared to the positions of the fasteners 120, 122 shown in FIG. 2B, the fastener 120 is at another end of the arcuate slot 116, and the fastener 122 is at another end of the arcuate slot 118. Further rotation of the trim ring 102 and the shielding reflector 110 in a counterclockwise direction is prevented by the fasteners 120, 122 abutting against the ends of the arcuate slots 116, 118.

The trim ring 102 and the shielding reflector 110 may be rotated relative to the ring structure 112 to positions other than shown in FIGS. 2A-2C. To illustrate, the fastener 120 may be at a position in the arcuate slot 116 that is between the positions shown in FIGS. 2A and 2C, and the fastener 122 may be at a position in the arcuate slot 118 that is between the positions shown in FIGS. 2A and 2C.

In some example embodiments, the tip portion of each hook 134, 136 may extend above the plate 114 of the ring structure 112 and come in contact with the plate 114 to resist bending of the ring structure 112. For example, the tip portion of each hook 134, 136 may rest on the surface of the plate 114 facing away from the trim ring 102. To illustrate, when the torsion springs 106, 108 are attached to a housing, the hooks 134, 136 may resist/prevent bending of the ring structure 112 that may result from downward and/or upward force that may tend to bend ring structure 112 about the fasteners 120, 122.

After the finishing section 100 is installed by attaching the torsion springs 106, 108 to a housing (e.g., a new or existing recessed housing), the trim ring 102 may be rotated relative to the ring structure 112 to align the trim ring 102, for example, with trim rings of other light fixtures without requiring removal the trim ring 102, the shielding reflector 110 or the housing.

In some alternative embodiments, the arcuate slots 116, 118 may be shorter or longer than shown in FIGS. 2A-2C. Further, as shown in FIGS. 2A-2C, the bracket attachment tabs 130, 132 shown in FIG. 1B may be omitted in some embodiments of the ring structure 112 and the finishing section 100.

Figure 3:
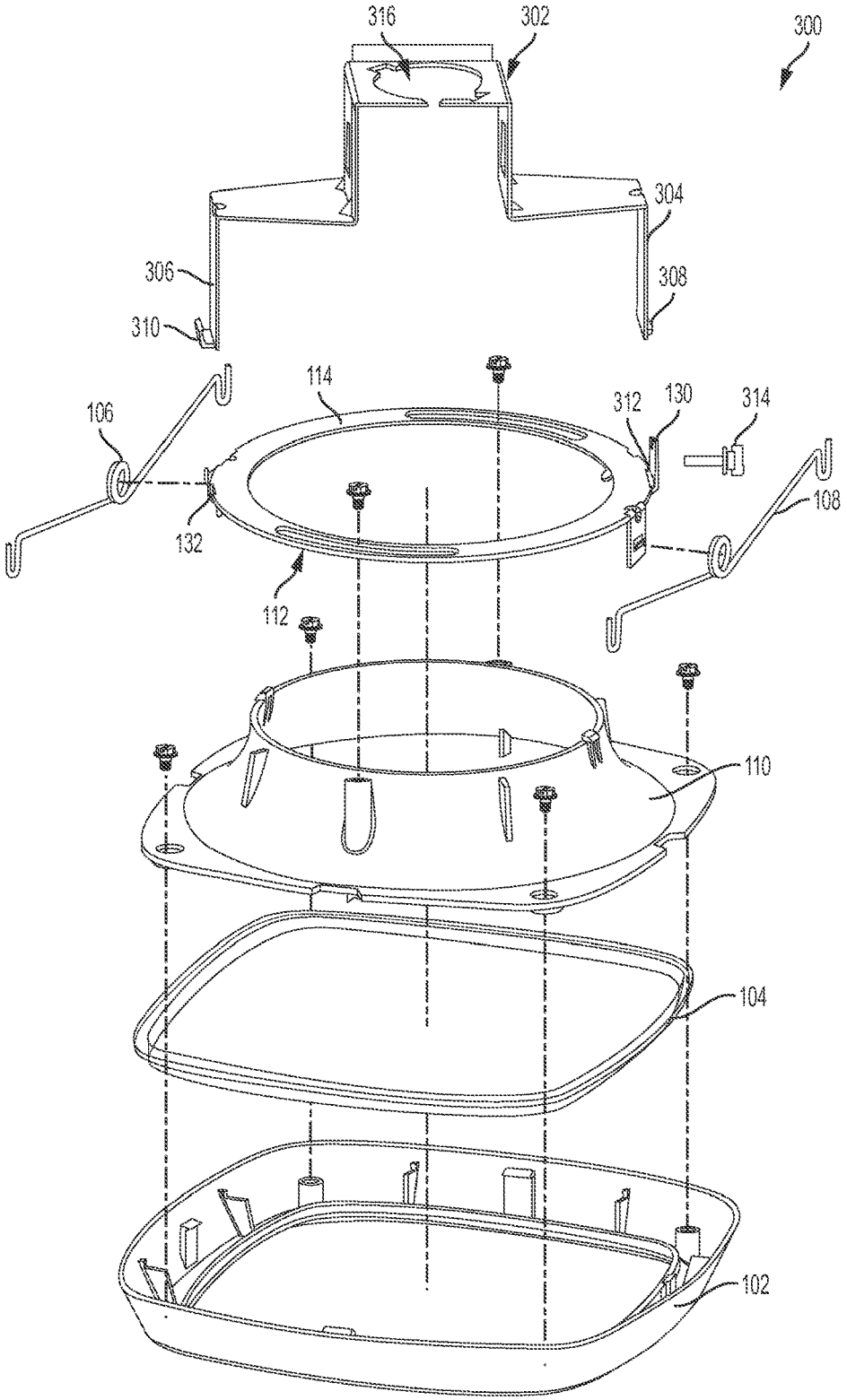
FIG. 3 illustrates an exploded view of a lighting structure including a lamp attachment bracket according to another example embodiment.

FIG. 3 illustrates an exploded view of a lighting structure 300 including a lamp attachment bracket 302 according to an example embodiment. In some example embodiments, the lighting structure 300 is substantially the same as the finishing section 100 of FIGS. 1A and 1B with the inclusion of the lamp attachment bracket 302. The lighting structure 300 includes the trim ring 102, the lens 104, the shielding reflector 110, and the ring structure 112. The lighting structure 300 may also include torsion springs 106, 108 or another attachment structure that are attached to the ring structure 112 and that are used to attach the lighting structure 300 to a light fixture housing. The lamp attachment bracket may be used to hold a lamp socket (shown in FIG. 6) such that a lamp attached to the lamp socket may extend down toward the lens 104 through the center of the ring structure 112 and the shielding reflector 110.

As described above, in some example embodiments, the ring structure 112 includes the bracket attachment tabs 130, 132. For example, the bracket attachment tabs 130, 132 may be used for attachment of the bracket 302 to the ring structure 112. To illustrate, in some example embodiments, the bracket 302 may include legs 304, 306 that extend toward the ring structure 112. For example, the legs 304, 306 may extend down from an opening 316 of the bracket 302 that is designed to receive the lamp socket.

In some example embodiments, the leg 304 may include an end portion 308 that is oriented generally horizontally with respect to the orientation of the lighting structure 300 shown in FIG. 3. The leg 306 may include an end portion 310 that is curved generally upward with respect to the orientation of the lighting structure 300 shown in FIG. 3. The end portion 308 of the leg 304 is designed to be inserted into a slot 312 that is between the bracket attachment tab 130 and the plate 114 of the ring structure 112. For example, the slot 312 may be between the outer edge of the plate 114 and the tab 130.

In some example embodiments, the end portion 310 of the leg 306 may also be inserted in slot (more clearly shown in FIG. 5) that is between the tab 132 and the plate 114. The legs 304, 306 may be moveable (e.g., bendable) to allow the insertion of the end portions 308, 310 into the respective slots formed in the ring structure 112. In some example embodiments, a fastener 314 (e.g., a screw) may be used to further secure the leg 304 and the tab 130 together after the end portion 308 is inserted into the slot 312. The end portions 308, 310 retain the bracket 302 attached to the ring structure 112.

The bracket 302 may be made from steel (e.g., galvanized steel) or another suitable material as may be contemplated by those of ordinary skill in the art with the benefit of this disclosure. To illustrate, the bracket 302 may be using methods such as stamping.

In some alternative embodiments, the lamp attachment bracket 302 may have a shape other than shown in FIG. 3 without departing from the scope of this disclosure. For example, the steps in each leg 304, 306 may be omitted.

Figure 4:
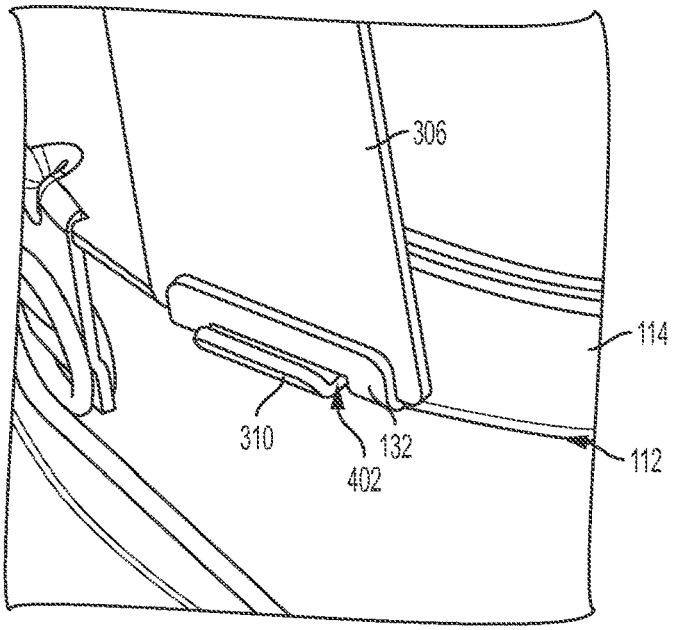
FIG. 4 is a close-up view illustrating attachment of a leg of the lamp attachment bracket to the ring structure of FIG. 3 according to an example embodiment.

FIG. 4 is a close-up view illustrating attachment of the leg 306 of the lamp attachment bracket 302 to the ring structure 112 of FIG. 3 according to an example embodiment. As illustrated in FIG. 4, the end portion 310 of the leg 306 is inserted in a slot 402 that is formed between the plate 114 of the ring structure 112 and the bracket attachment tab 132. The end portion 310 is curved/bent generally upward, which may resist unintentional detachment of the leg 306 from the ring structure 112. In some example embodiments, the end portion 310 may be oriented in a different direction than shown in FIG. 4 without departing from the scope of this disclosure.

Figure 5:
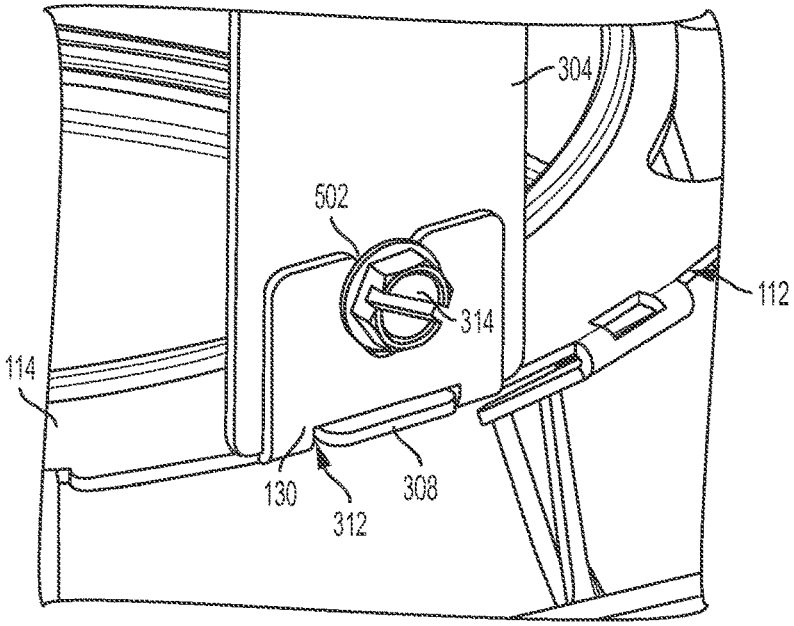
FIG. 5 is a close-up view illustrating attachment of another leg of the lamp attachment bracket to the ring structure of FIG. 3 according to an example embodiment.

FIG. 5 is a close-up view illustrating attachment of the leg 304 of the lamp attachment bracket 302 to the ring structure 112 of FIG. 3 according to an example embodiment. As illustrated in FIG. 5, the end portion 308 of the leg 304 is extends through the slot 312 that is formed between the plate 114 of the ring structure 112 and the bracket attachment tab 130. The end portion 308 extends in a generally horizontal direction but, in some alternative embodiments, may be curved/bent upward or downward without departing from the scope of this disclosure. In some alternative embodiments, the end portion 308 may extend through the slot 312 less or more than shown in FIG. 5 without departing from the scope of this disclosure.

In some example embodiments, the fastener 314 may extend through a notch 502 in the tab 130 and a corresponding hole in the leg 304 to fasten the tab 130 to the leg 304. For example, the fastener 314 may be a threaded fastener that may be tightened and loosened using a tool such as a screw driver. In some alternative embodiments, the tab 130 may have a round hole or a hole having another shape instead of the notch 502.

Figure 6:
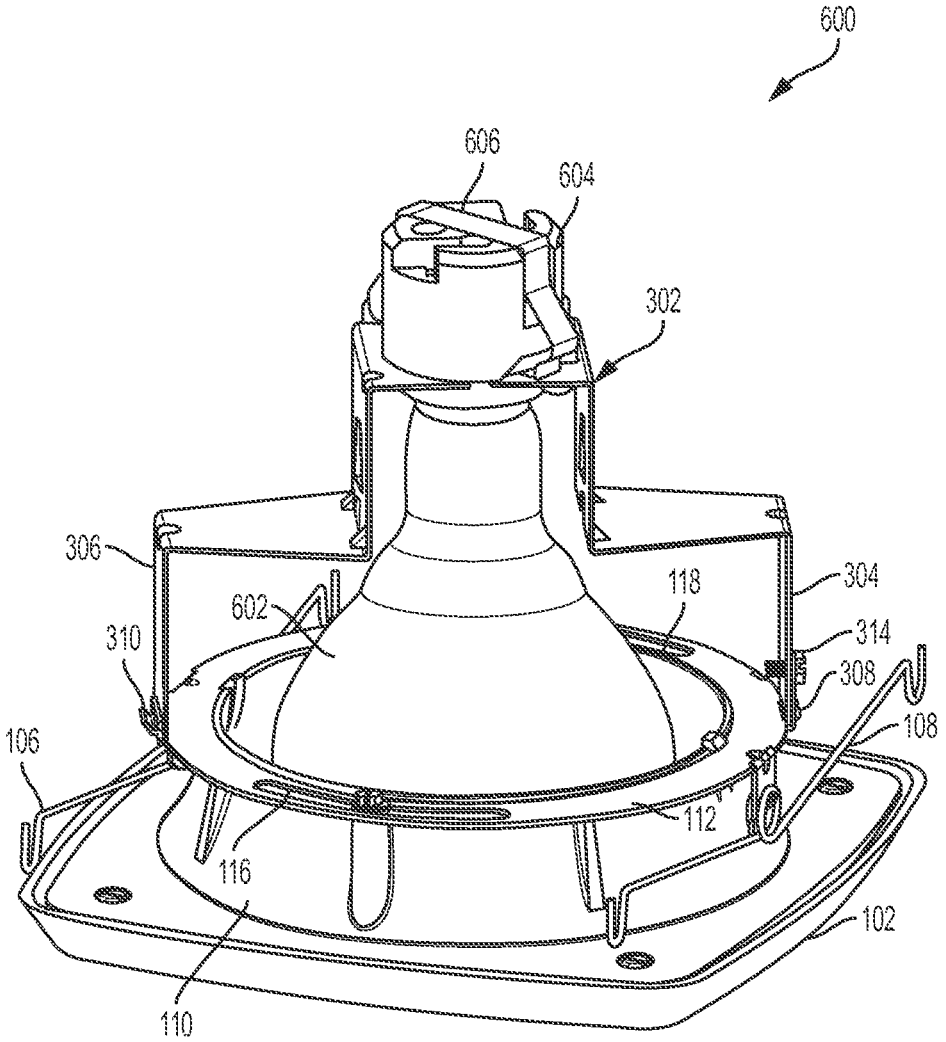
FIG. 6 illustrates a lamp attached to the lamp attachment bracket of FIG. 3 according to an example embodiment.

FIG. 6 illustrates a lighting structure 600 including a lamp 602 attached to the lamp attachment bracket 302 of FIG. 3 according to an example embodiment. In some example embodiments, the lighting structure 600 is substantially the same as the lighting structure 300 of FIG. 3 with the inclusion of the lamp 602. As illustrated in FIG. 6, the lamp attachment bracket 302 is attached to the ring structure 112. The end portion 310 of the leg 306 of the bracket 302 extends through the slot 402 (more clearly shown in FIG. 4), and the end portion 308 extends through the slot 312 (more clearly shown in FIG. 4). The leg 304 and the tab 130 (more clearly shown in FIG. 5) are fastened to each other by the fastener 314.

As described above, the ring structure 112 is attached to the shielding reflector 110. In some example embodiments, the shielding reflector 110 and the ring structure 112 are rotatable with respect to each other. The trim ring 102 is rotationally fixed with respect to the shielding reflector 110 such that the trim ring 102 rotates along with the shielding reflector 110 relative to the ring structure 112. As described above, the torsion springs 106, 108 are attached to the ring structure 112 and are designed to attach the lighting structure 600 to a lighting fixture housing.

As illustrated in FIG. 6, a lamp socket 604 is attached to the bracket 302. For example, a portion of the lamp socket 604 may extend through the opening 316 (more clearly shown in FIG. 3). In some example embodiments, a spring 606 may retain the lamp socket 604 attached to the bracket 302. Alternatively, the lamp socket 606 may be retained by another means as may be contemplated by those of ordinary skill in the art with the benefit of this disclosure. The lamp 602 is attached to the lamp socket 604 and extends into towards the lens 104 (shown in FIG. 3) through the shielding reflector 110. In some example embodiments, the lamp attachment bracket 302 may serve to hold the lamp 602 such that the lamp 602 is spaced enough from the lens 104 to avoid/reduce heat damage to the lens 104 from heat emitted by the lamp 602. The lamp 602 may be a PAR lamp or another type of lamp other than shown in FIG. 6 without departing from the scope of this disclosure.

Although trim ring 102 and the shielding reflector 110 are described above as being rotatable relative to the ring structure 112, in some alternative embodiments, the trim ring 102 and the shielding reflector 110 may be rotationally fixed with respect to the ring structure 112. For example, the ring structure 112 may include small fastener slots instead of the arcuate slots 116, 118 for fixedly attaching the ring structure 112 to the shielding reflector 110 using fasteners that retain the shielding reflector 110 and the ring structure 112 rotationally fixed with respect to each other.

Figure 7:
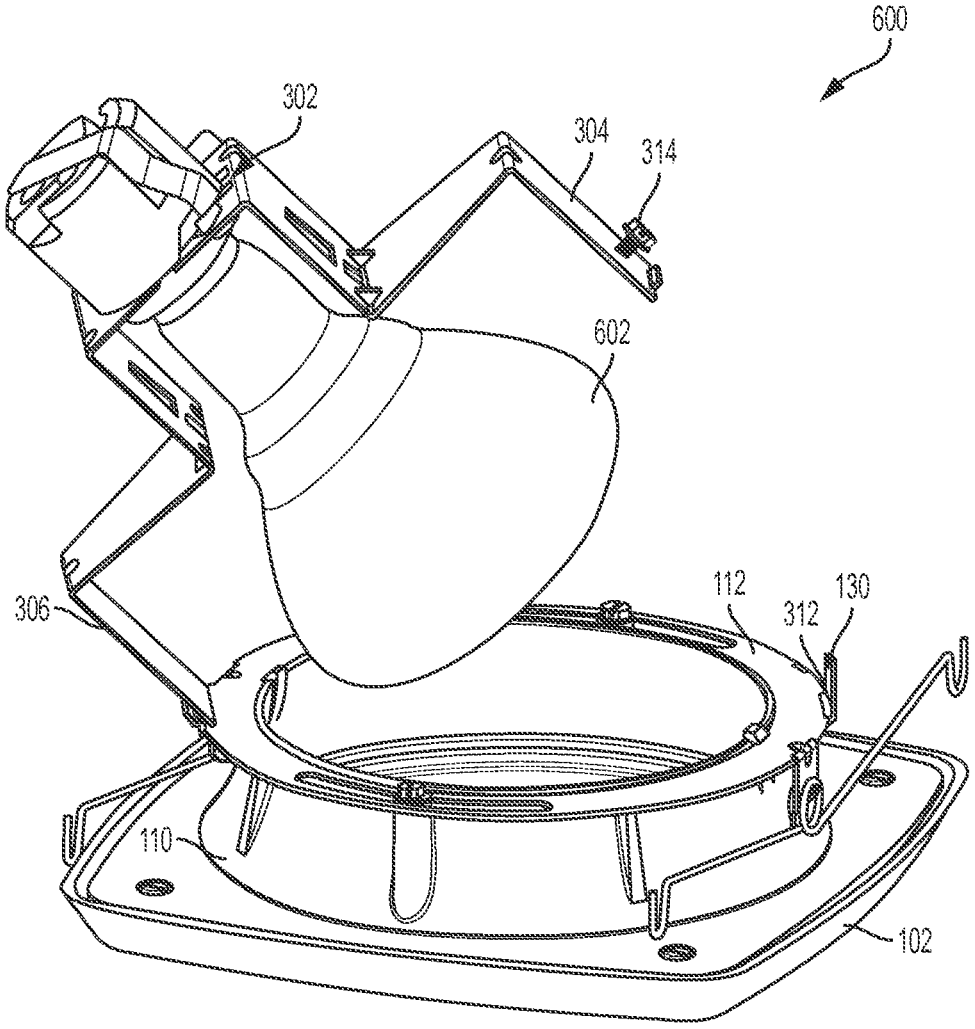
FIG. 7 illustrates the lighting structure FIG. 6 having a leg detached from the ring structure according to an example embodiment.

FIG. 7 illustrates the lighting structure 600 having the leg 304 detached from the ring structure 112 according to an example embodiment. For example, the fastener 314 may be loosened and the end portion 308 of the leg 304 of the bracket 302 pulled out of the slot 312 to detach the leg 304 from the tab 130 and the ring structure 112. For example, the fastener 314 may be loosened but remain attached to the leg 304. As illustrated in FIG. 7, the leg 306 may remain attached to the ring structure 112 after the leg 304 is detached. By retaining the ring structure 112, along with the shielding reflector 110 and the trim ring 102, using the leg 306 of the bracket 302, a user may replace the lamp 602 without having to climb down a ladder to put away the trim ring 102, the shielding reflector 110 and the ring structure 112.

Figure 8:
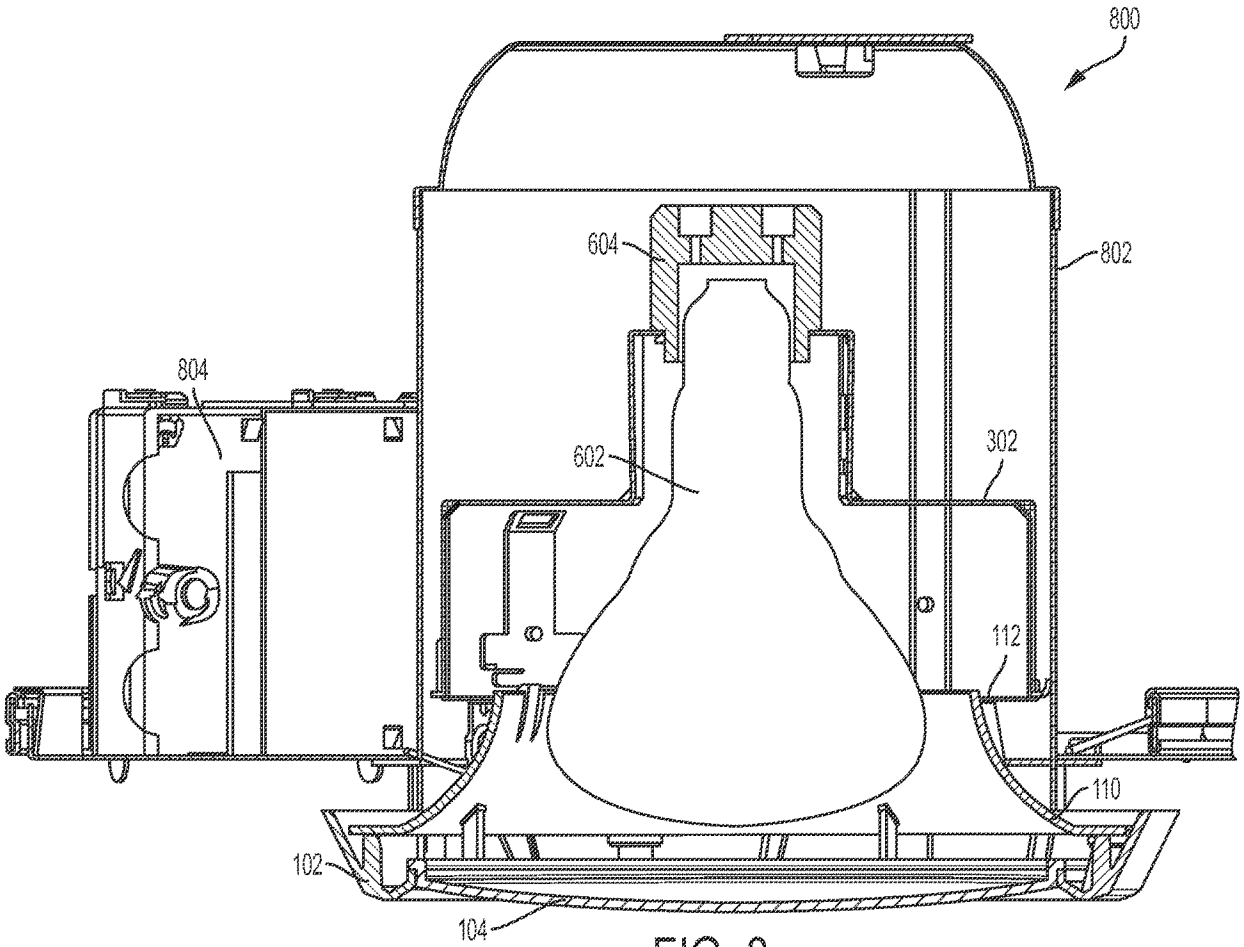
FIG. 8 is a cross-sectional view of a lighting fixture including the lighting structure of FIG. 6 according to an example embodiment.

FIG. 8 is a cross-sectional view of a lighting fixture 700 including the lighting structure 600 of FIG. 6 according to an example embodiment. The lighting fixture 800 includes the trim ring 102, the lens 104, the shielding reflector 110, the ring structure 112, and the lamp attachment bracket 302 that is to the ring structure 112. For example, the ring structure 112 may be attached to a housing 802 using torsion springs 106, 108 shown, for example, in FIGS. 1A, 1B, 3, and 6. A junction box 804 may be attached to the housing 802. Wires (not shown) may be routed to the lamp socket 604 via the junction box 804. The lamp 602 is attached to the lamp socket 604 as described above. The trim ring 102, the lens 104, and a portion of the shielding reflector 110 may be positioned outside of the housing 802.

Figure 9:
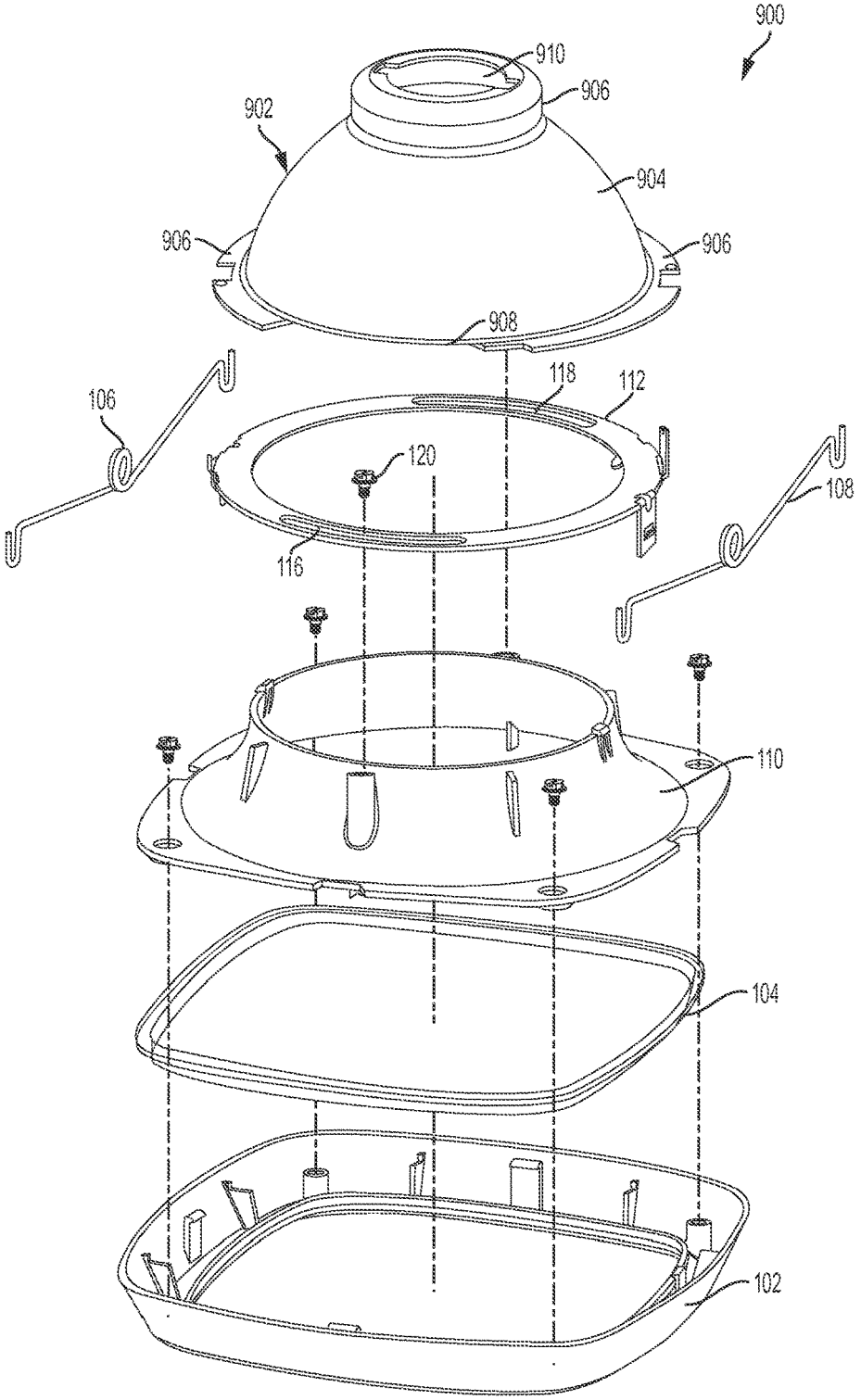
FIG. 9 illustrates an exploded view of a lighting structure including a reflector according to another example embodiment.

FIG. 9 illustrates an exploded view of a lighting structure 900 including a reflector 902 according to another example embodiment. In some example embodiments, the lighting structure 900 is substantially the same as the finishing section 100 of FIGS. 1A and 1B with the inclusion of the reflector 902. The lighting structure 900 includes the trim ring 102, the lens 104, the shielding reflector 110, and the ring structure 112. As illustrated in FIG. 9, the tabs 130, 132 shown in FIG. 1B may be omitted. The trim ring 102 and the shielding reflector 110 are attached to each other in the same manner as described above. The torsion springs 106, 108 may be used to attach the ring structure 112 to a housing as described above.

In some example embodiments, the reflector 902 may include a bottom dome shaped portion 904 extends down from a top portion 906 and a flange 906. The top portion 906 may include an opening 910 designed to receive a lamp socket such as shown in FIG. 6. A lamp, such as the lamp 602 of FIG. 6, may be attached to the lamp socket from under the reflector 902. A flange 906 may extend out from the bottom portion 904.

The flange 906, which includes a gap 908, rests on the ring structure 112. The reflector 902 may be securely attached to the ring structure 112 using none or more fasteners (not shown) such as screws and clamps. The gap 908 allows the fastener 116 to extend through the arcuate slot 120 to attach to the shielding reflector 110. The flange 906 may include another gap similar to the gap 908 to allow a fastener to extend through the arcuate slot 122 to attach to the shielding reflector 110.

The reflector 902 may be made from a reflective e material as may be contemplated by those of ordinary skill in the art with the benefit of this disclosure. Although the reflector 902 is shown as having a dome shape, in some alternative embodiments, the reflector 902 may have other shapes without departing from the scope of this disclosure.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A finishing section for a recessed lighting fixture, comprising:

a trim structure comprising a shielding reflector and a trim ring, wherein the shielding reflector is attached to the trim ring;

a ring structure attached to the shielding reflector distal from the trim ring, wherein a fastener attached to the shielding reflector extends through a slot formed through a plate of the ring structure and wherein the trim structure and the ring structure are rotatable relative to each other when the fastener is positioned through the slot; and a bracket attached to the ring structure, the bracket having a first leg and a second leg.

2. The finishing section of claim 1, wherein the slot is a first arcuate slot, and wherein a second fastener attached to the shielding reflector is positioned through a second arcuate slot formed through the plate of the ring structure.

3. The finishing section of claim 2, wherein the fastener and the second fastener are positioned radially opposite each other.

4. The finishing section of claim 2, wherein the first arcuate slot and the second arcuate slot each have an arc of approximately 45 degrees.

5. The finishing section of claim 1, wherein the trim ring has a rectangular outer perimeter.

6. The finishing section of claim 1, wherein the shielding reflector includes a rib extending outwardly from the shielding reflector, wherein the ring structure includes a locking tab having a slot and extending down from the plate of the ring structure, and wherein the rib and the locking tab prevent a rotation of the ring structure and the trim structure relative to each other when the rib is positioned in the slot of the tab.

7. The finishing section of claim 1, further comprising torsion springs attached to the ring structure.

8. The finishing section of claim 1, further comprising a reflector attached to the ring structure.

9. The finishing section of claim 1, wherein the shielding reflector includes a first hook and a second hook and wherein a tip portion of the first hook and a tip portion the second hook rest on a surface of the plate of the ring structure facing away from the trim ring.

10. The finishing section of claim 1, wherein the trim ring includes a first hook and a second hook and wherein the first hook and the second hook retain the shielding reflector and the trim ring attached to each other.

11. A lighting structure for a recessed lighting fixture, comprising:

a trim structure comprising a shielding reflector and a trim ring, wherein the shielding reflector is attached to the trim ring;

a ring structure attached to the shielding reflector distal from the trim ring, the ring structure including a first bracket attachment tab and a second bracket attachment tab, wherein a fastener attached to the shielding reflector extends through an arcuate slot formed through a plate of the ring structure;

a bracket attached to the ring structure, the bracket having a first leg and a second leg, wherein an end portion of the first leg extends through a first slot, and wherein an end portion of the second leg extends through a second slot; and a top reflector attached to the ring structure and positioned between the ring structure and the bracket, the top reflector having an opening distal from the ring structure to receive a lamp socket.

12. The lighting structure of claim 11, further comprising a removable fastener securing the first leg to the first bracket attachment tab.

13. The lighting structure of claim 11, wherein the first bracket attachment tab and the second bracket attachment tab are positioned radially opposite each other.

14. The lighting structure of claim 11, further comprising a lamp socket and a lamp, the lamp socket attached to the bracket distal from the ring structure, wherein the lamp is attached to the lamp socket.

15. The lighting structure of claim 14, wherein the lamp extends from the lamp socket through a center of the ring structure, wherein an upper portion of the lamp is outside of the shielding reflector between a portion of the bracket and the ring structure, and wherein a lower portion of the lamp is in a cavity of the shielding reflector.

16. The lighting structure of claim 11, wherein the ring structure and the bracket are rotatable relative to the shielding reflector when the fastener is positioned through the arcuate slot and wherein the trim ring is rotatable along with the shielding reflector.

17. The lighting structure of claim 11, wherein the ring structure remains attached to the bracket by the second leg of the bracket when the first leg of the bracket is detached from the ring structure.

18. A lighting structure for a recessed lighting fixture, comprising:

a trim structure comprising a shielding reflector and a trim ring, wherein the shielding reflector is attached to the trim ring;

a ring structure attached to the shielding reflector distal from the trim ring, wherein a fastener attached to the shielding reflector extends through a slot formed through a plate of the ring structure and wherein the trim structure and the ring structure are rotatable relative to each other when the fastener is positioned through the slot;

a reflector attached to the ring structure, the reflector having an opening distal from the ring structure to receive a lamp socket; and a bracket attached to the ring structure, the bracket having a first leg and a second leg.

19. The lighting structure of claim 18, wherein the slot is a first arcuate slot formed in the plate of the ring structure, and wherein a second fastener attached to the shielding reflector extends through a second arcuate slot formed through the plate of the ring structure.

20. The lighting structure of claim 19, wherein the fastener and the second fastener are positioned radially opposite each other.

* * * * *